US012044124B2

(12) United States Patent
Al-Malki et al.

(10) Patent No.: US 12,044,124 B2
(45) Date of Patent: Jul. 23, 2024

(54) METHOD AND SYSTEM FOR REAL-TIME HOLE CLEANING USING A GRAPHICAL USER INTERFACE AND USER SELECTIONS

(71) Applicants: SAUDI ARABIAN OIL COMPANY, Dhahran (SA); KING FAHD UNIVERSITY OF PETROLEUM & MINERALS, Dhahran (SA)

(72) Inventors: Mohammed A. Al-Malki, Dhahran (SA); Mahmoud F. Abughaban, Dhahran (SA); Mohammed Murif Al-Rubaii, Dhahran (SA); Abdullah S. Al-Yami, Dhahran (SA); Salaheldin M. Elkatatny, Dhahran (SA)

(73) Assignees: SAUDI ARABIAN OIL COMPANY, Dhahran (SA); KING FAHD UNIVERSITY OF PETROLEUM & MINERALS, Dhahran (SA)

( * ) Notice: Subject to any disclaimer, the term of this patent is extended or adjusted under 35 U.S.C. 154(b) by 744 days.

(21) Appl. No.: 17/168,592

(22) Filed: Feb. 5, 2021

(65) Prior Publication Data

US 2022/0251950 A1 Aug. 11, 2022

(51) Int. Cl.
*E21B 49/00* (2006.01)
*E21B 21/08* (2006.01)
(Continued)

(52) U.S. Cl.
CPC ..... *E21B 49/003* (2013.01); *E21B 21/08* (2013.01); *E21B 37/00* (2013.01); *E21B 44/02* (2013.01);
(Continued)

(58) Field of Classification Search
None
See application file for complete search history.

(56) References Cited

U.S. PATENT DOCUMENTS 5,063,776 A 11/1991 Zanker et al.
6,115,671 A 9/2000 Fordham et al.
(Continued)

FOREIGN PATENT DOCUMENTS

CN 101899969 B 4/2013
IN 102839934 A 12/2012
(Continued)

OTHER PUBLICATIONS

Ofei, Titus Ntow, "Effect of Yield Power Law Fluid Rheological Properties on Cuttings Transport in Eccentric Horizontal Narrow Annulus", Journal of Fluids, Hindawi Publishing Corporation, vol. 2016, Article ID 4931426, 2016, pp. 1-10 (10 pages).
(Continued)

*Primary Examiner* — Mohammad Ali
*Assistant Examiner* — Saad M Kabir
(74) *Attorney, Agent, or Firm* — Osha Bergman Watanabe & Burton LLP

(57) ABSTRACT

A method may include obtaining, in real-time, well data regarding a wellbore and drilling fluid data regarding drilling fluid circulating in the wellbore. The method may further include determining, based on the drilling fluid data, a plastic viscosity (PV) value and a yield point (YP) value regarding the drilling fluid. The method may further include determining, based on the well data and the drilling fluid data, an equivalent circulating density (ECD) value of an annulus of the wellbore. The method may further include determining a hole cleaning efficiency (HCE) value based on a hole cleaning model, the PV value, the YP value, and the ECD value. The method may further include determining an adjusted rate of penetration (ROP) value for a drilling operation in the wellbore based on the HCE value and a current ROP value. The method may further include trans-
(Continued)

mitting a command to a drilling system that produces the adjusted ROP value in the drilling operation.

19 Claims, 10 Drawing Sheets

(51) Int. Cl.
*E21B 37/00* (2006.01)
*E21B 44/02* (2006.01)
*E21B 47/12* (2012.01)

(52) U.S. Cl.
CPC ..... *E21B 47/12* (2013.01); *E21B 49/005* (2013.01); *E21B 2200/20* (2020.05)

(56) References Cited

U.S. PATENT DOCUMENTS

| | | | |
|---|---|---|---|
| 6,357,536 | B1 | 3/2002 | Schrader et al. |
| 10,449,477 | B2 | 10/2019 | Johnson et al. |
| 10,487,603 | B2 | 11/2019 | Manwill et al. |
| 2002/0010548 | A1 | 1/2002 | Tare et al. |
| 2003/0052673 | A1 | 3/2003 | Speier et al. |
| 2009/0188718 | A1 | 7/2009 | Kaageson-Loe et al. |
| 2009/0250264 | A1 | 10/2009 | Dupriest |
| 2010/0026293 | A1 | 2/2010 | Minh |
| 2011/0174541 | A1 | 7/2011 | Strachan et al. |
| 2013/0080066 | A1 | 3/2013 | Al-Dossary et al. |
| 2013/0299241 | A1 | 11/2013 | Alberty et al. |
| 2014/0326449 | A1 | 11/2014 | Samuel et al. |
| 2015/0211350 | A1 | 7/2015 | Norman et al. |
| 2015/0292323 | A1 | 10/2015 | Shahri et al. |
| 2015/0300151 | A1 | 10/2015 | Mohaghegh |
| 2016/0053604 | A1 | 2/2016 | Abbassian et al. |
| 2016/0231450 | A1 | 8/2016 | Shao et al. |
| 2016/0370492 | A1 | 12/2016 | Chen et al. |
| 2017/0044896 | A1 | 2/2017 | Salminen |
| 2017/0075004 | A1 | 3/2017 | McColpin et al. |
| 2017/0176228 | A1 | 6/2017 | Elisabeth |
| 2017/0191919 | A1 | 7/2017 | Kulkarni et al. |
| 2018/0003045 | A1 | 1/2018 | Dotson et al. |
| 2018/0012384 | A1 | 1/2018 | Marland et al. |
| 2018/0037797 | A1 | 2/2018 | Brady et al. |
| 2018/0106147 | A1 | 4/2018 | Lakings et al. |
| 2018/0127632 | A1 | 5/2018 | Amanullah |
| 2018/0266197 | A1 | 9/2018 | Amanullah et al. |
| 2018/0335530 | A1 | 11/2018 | Wu et al. |
| 2019/0094119 | A1 | 3/2019 | Singh et al. |
| 2019/0178770 | A1 | 6/2019 | Marum et al. |
| 2019/0316457 | A1 | 10/2019 | Al-Rubaii et al. |
| 2020/0270958 | A1 | 8/2020 | Omrani et al. |
| 2020/0355839 | A1 | 11/2020 | Jeong et al. |
| 2020/0362694 | A1 | 11/2020 | Al-Rubaii et al. |
| 2020/0362695 | A1 | 11/2020 | Al-Rubaii et al. |
| 2020/0370381 | A1 | 11/2020 | Al-Rubaii et al. |
| 2020/0370426 | A1 | 11/2020 | Dugas |
| 2020/0371495 | A1 | 11/2020 | Al-Rubaii et al. |

FOREIGN PATENT DOCUMENTS

| | | | |
|---|---|---|---|
| WO | 2010054476 | A1 | 5/2010 |
| WO | 2015/072962 | A1 | 5/2015 |
| WO | 2015191091 | A1 | 12/2015 |
| WO | 2018/208634 | A1 | 11/2018 |
| WO | 2020139415 | A1 | 7/2020 |
| WO | 2020142073 | A1 | 7/2020 |

OTHER PUBLICATIONS

Robinson, Leon and Mark Morgan, "Effect of Hole Cleaning on Drilling Rate and Performance", AADE-04-DF-HO-42, American Association of Drilling Engineers, Apr. 2004, pp. 1-7 (7 pages).

Williams, Jr., C.E. and G.H. Bruce, "Carrying Capacity of Drilling Muds", T.P. 3026, Petroleum Transactions, AIME, vol. 192, 1951, pp. 111-120 (10 pages).

Pigott, R.J.S., "Mud Flow in Drilling", Drilling and Production Practice, American Petroleum Institute, 1941, pp. 91-103 (13 pages).

Raheem, Oriyomi Nurudeen et al., "Using NMR T2 to Predict the Drainage Capillary Curves Pc-Sw in Carbonates Reservoirs", SPE-185989-MS, Society of Petroleum Engineers, May 2017, pp. 1-34 (34 pages).

Arns, C.H. et al., "Prediction of permeability from NMR response: surface relaxivity heterogeneity", SPWLA 47th Annual Logging Symposium, Society of Petrophysicists and Well Log Analysts, Jun. 2006, pp. 1-13 (13 pages).

Nicot, Benjamin et al., "Improvement of Viscosity Prediction Using NMR Relaxation", SPWLA 48th Annual Logging Symposium, Society of Petrophysicists and Well Log Analysts, Jun. 2007, pp. 1-7 (7 pages).

Final Office Action issued in corresponding U.S. Appl. No. 17/174,625, mailed Mar. 31, 2023 (62 pages).

Office Action issued in corresponding U.S. Appl. No. 17/174,625, issued Oct. 24, 2022 (43 pages).

Di, Jianwei and Jerry L. Jensen, "A New Approach for Permeability Prediction With NMR Measurements in Tight Formations", Aug. 2016 SPE Reservoir Evaluation & Engineering, Society of Petroleum Engineers, 2016, pp. 481-493 (13 pages).

Dziuba, Taras T., "Improved Permeability Prediction in Carbonates", SPWLA 37th Annual Logging System Symposium, Jun. 1996, pp. 1-12 (12 pages).

Lonnes, Steve et al., "NMR Petrophysical Predictions on Cores", SPWLA 44th Annual Logging Symposium, Jun. 2003, pp. 1-14 (14 pages).

Keating, Kristina et al., "Improving pore-size distribution and permeability prediction from NMR using DT2 maps", SEG International Exposition and 89th Annual Meeting, SEG, 2019, pp. 4809-4813 (5 pages).

Wampler, J.J. et al., "Estimating permeability in UAE carbonates using NMR", SEG Denver 2010 Annual Meeting, SEG, 2010, pp. 2649-2653 (5 pages).

Zayed, Samy et al., "Permeability Prediction Using NMR Measurements for Some Gas Reservoirs—Nile Delta, Egypt", 14th Offshore Mediterranean Conference and Exhibition, Mar. 2019, pp. 1-11 (11 pages).

Musu, Junita Trivianty and Bambang Widarsono, "Determination of NMR T2 cut off for ductile, low permeability shaly sandstone", ASEG Extended Abstracts, Taylor & Francis, 2007:1, pp. 1-10 (11 pages).

Besghini, Denise et al., "Time Domain NMR in Polymer Science: From the Laboratory to the Industry", Applied Sciences, MDPI, vol. 9, No. 1801, Apr. 2019, pp. 1-33 (33 pages).

Salimifard, Babak et al., "Optimizing NMR Data Acquisition and Data Processing Parameters for Tight-Gas Montney Formation of Western Canada", SCA2017-020, International Syposium of the Society of Core Analysts, Aug.-Sep. 2017, pp. 1-13 (13 pages).

Mohammadsalehi. M. and Malekzadah, N.; "Application of New Hole Cleaning Optimization Method within All Ranges of Hole Inclinations", IPTC 14154; International Petroleum Technology Conference; Feb. 2012; pp. 1-8 (8 pages).

Samsuri, A. and Hamzah, A.; "Water based mud lifting capacity improvement by multiwall carbon nanotubes additive", Journal of Petroleum and Gas Engineering; vol. 2; No. 5; Apr. 12, 2011; pp. 99-107 (9 pages).

H. N. Hall et al.; "Ability of Drilling Mud to Lift Bit Cuttings", Petroleum Transactions, AIME; vol. 189; 1950; pp. 35-46 (12 pages).

Pandya et al.; "Effects of Particle Density on Hole Cleanout Operation in Horizontal and Inclined Wellbores", SPE-194240-MS; Society of Petroleum Engineers; Mar. 2019; pp. 1-22 (22 pages).

Walker, R.E. and Mayes, T. M.; "Design of Muds for Carrying Capacity", SPE-4975-PA; Journal of Petroleum Technology; vol. 27; No. 7; Jul. 1975; pp. 893-900 (8 pages).

R. H. McLean; "Velocities, Kinetic Energy and Shear in Crossflow Under Three-Cone Jet Bits", SPE 1306; Society of Petroleum Engineers; Dec. 1965; pp. 1443-1448 (6 pages).

(56) References Cited

OTHER PUBLICATIONS

International Search Report and Written Opinion issued in corresponding International Patent Application No. PCT/US2022/015320, mailed on May 11, 2022 (12 pages).
International Search Report and Written Opinion issued in corresponding International Patent Application No. PCT/US2022/016160, mailed on May 11, 2022 (18 pages).
"Permeability estimation with NMR logging", PetroWiki, Glenda Smith; Mar. 27, 2013, https://petrowiki .spe.org/Permeability_estimation_with_NMR_logging; https://petrowiki .spe.org/File:Vol5_Page_0323_Image_0001.png (Year: 2013) (5 pages).
Non-Final Office Action issued in related U.S. Appl. No. 17/174,625 dated Oct. 2, 2023 (43 pages).
Smith, G., "Permeability estimation with NMR logging," PetroWiki, pp. 1-5, https://petrowiki.spe.org/Permeability_estimation_with_NMR_logging; https://petrowiki.spe.org/File:Vol5_Page_0323_Image_0001.png, 2013, accessed on Sep. 25, 2023 (5 pages).
Gooneratne, C.P. et al., "Downhole Applications of Magnetic Sensors," MDPI, Sensors, vol. 17, No. 2384, pp. 1-32, dated Oct. 19, 2017 (32 pages).
Office Action issued in corresponding U.S. Appl. No. 17/174,625; dated Feb. 26, 2024 (47 pages).
Alawami, M. et al., "SPE-196448-MS: A Real-Time Indicator for the Evaluation of Hole Cleaning—Å Efficiency," SPE International, Society of Petroleum Engineers, pp. 1-9, Oct. 25, 2020 (9 pages).
Al-Rubaii, M.M. et al., "IPTC-19809-MS: Automated Evaluation of Hole Cleaning Efficiency While Drilling Improves Rate of Penetration," IPTC, pp. 1-17, Jan. 13, 2020 (17 pages).
Office Action issued in corresponding Saudi Arabian Application No. 122440690; dated May 6, 2024 (6 pages).

Survey Table

| MD ft | INC deg | AZI deg | TVD ft | DISPEW ft | DISPNS ft | DLS deg/100π |
|---|---|---|---|---|---|---|
| 15124 | 79.07 | 80.14 | 14187.69 | 1418.95 | 392.91 | 0.69 |
| 15215 | 79.39 | 81.72 | 14204.7 | 1507.22 | 407 | 1.74 |
| 15307 | 80.83 | 85.55 | 14220.51 | 1597.28 | 417.03 | 4.39 |
| 15398 | 82.01 | 84.49 | 14234.08 | 1686.92 | 424.85 | 1.74 |
| 15490 | 83.69 | 83.93 | 14245.53 | 1777.73 | 434.06 | 1.93 |
| 15588 | 84.99 | 83.8 | 14255.19 | 1874.69 | 444.49 | 1.33 |
| 15685 | 87.1 | 85.38 | 14261.88 | 1971.02 | 453.61 | 2.71 |
| 15775 | 86.73 | 83.49 | 14266.72 | 2060.46 | 462.33 | 2.14 |
| 15871 | 86.36 | 84.28 | 14272.51 | 2155.74 | 472.54 | 0.91 |
| 15970 | 85.55 | 83.57 | 14279.5 | 2253.94 | 482.99 | 1.08 |
| 16062 | 85.3 | 82.5 | 14286.84 | 2344.97 | 494.11 | 1.19 |
| 16160 | 86.48 | 85.2 | 14293.86 | 2442.15 | 504.57 | 3 |
| 16251 | 86.66 | 83.92 | 14299.3 | 2532.57 | 513.18 | 1.42 |
| 16351 | 88.46 | 86.26 | 14303.56 | 2632.1 | 521.72 | 2.95 |
| 16443 | 86.91 | 87.65 | 14307.27 | 2723.89 | 526.61 | 2.26 |
| 16534 | 86.23 | 86.37 | 14312.71 | 2814.61 | 531.34 | 1.59 |
| 16633 | 87.04 | 84.65 | 14318.52 | 2913.13 | 539.08 | 1.92 |
| 16731 | 86.48 | 85.15 | 14324.06 | 3010.58 | 547.78 | 0.77 |
| 16825 | 86.17 | 84.79 | 14330.09 | 3104.03 | 556 | 0.5 |

FIG. 6C

METHOD AND SYSTEM FOR REAL-TIME HOLE CLEANING USING A GRAPHICAL USER INTERFACE AND USER SELECTIONS

BACKGROUND

Drilling fluid, also called drilling mud, may be a heavy, viscous fluid mixture that is used in oil and gas drilling operations to carry rock cuttings from a wellbore back to the surface. Drilling mud may also be used to lubricate and cool a drill bit. The drilling fluid, by hydrostatic pressure, may also assist in preventing the collapse of unstable strata into the wellbore as well as the intrusion of water from stratigraphic formations proximate the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining, by a computer processor and in real-time, well data regarding a wellbore and drilling fluid data regarding drilling fluid circulating in the wellbore. The method further includes determining, by the computer processor and based on the drilling fluid data, a plastic viscosity (PV) value and a yield point (YP) value regarding the drilling fluid. The method further includes determining, by the computer processor and based on the well data and the drilling fluid data, an equivalent circulating density (ECD) value of an annulus of the wellbore. The method further includes determining, by the computer processor, a hole cleaning efficiency (HCE) value based on a hole cleaning model, the PV value, the YP value, and the ECD value. The method further includes determining, by the computer processor, an adjusted rate of penetration (ROP) value for a drilling operation in the wellbore based on the HCE value and a current ROP value. The method further includes transmitting, by the computer processor, a command to a drilling system that produces the adjusted ROP value in the drilling operation.

In general, in one aspect, embodiments relate to a system that includes a drilling system including a drill string and various sensors. The drilling system is coupled to a wellbore. The system further includes a mud pump system coupled to the wellbore, where the mud pump system supplies drilling fluid to the wellbore. The system further includes a control system coupled to the drilling system and the mud pump system. The control system includes a computer processor. The control system obtains, in real-time, well data regarding the wellbore and drilling fluid data regarding the drilling fluid. The control system determines, based on the drilling fluid data, a plastic viscosity (PV) value and a yield point (YP) value regarding the drilling fluid. The control system determines, based on the well data and the drilling fluid data, an equivalent circulating density (ECD) value of an annulus of the wellbore. The control system determines a hole cleaning efficiency (HCE) value based on a hole cleaning model, the PV value, the YP value, and the ECD value. The control system determines an adjusted rate of penetration (ROP) value for a drilling operation in the wellbore based on the HCE value and a current ROP value. The control system transmits a command to the drilling system that produces the adjusted ROP value in the drilling operation.

In general, in one aspect, embodiments relate to a user device that includes a display device and a processor coupled to the display device. The user device further includes a memory coupled to the processor. The memory includes instructions that present, using a graphical user interface in the display device, various hole cleaning efficiency (HCE) values in association with one or more rate of penetration (ROP) values for a drilling operation regarding a wellbore. The HCE values are based on a hole cleaning model, a plastic viscosity (PV) value, a yield point (YP) value, and an equivalent circulating density of an annulus (ECD) value regarding the wellbore. The memory further includes instructions that obtain, in response to presenting the HCE values, a user selection of an adjusted ROP value. The memory further includes instructions that transmit, in response to the user selection, a command to a drilling system that produces the adjusted ROP value in the drilling operation.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

FIGS. 5, 6A, 6B, 6C, and 6D show examples in accordance with one or more embodiments.

DETAILED DESCRIPTION

Figure 1:
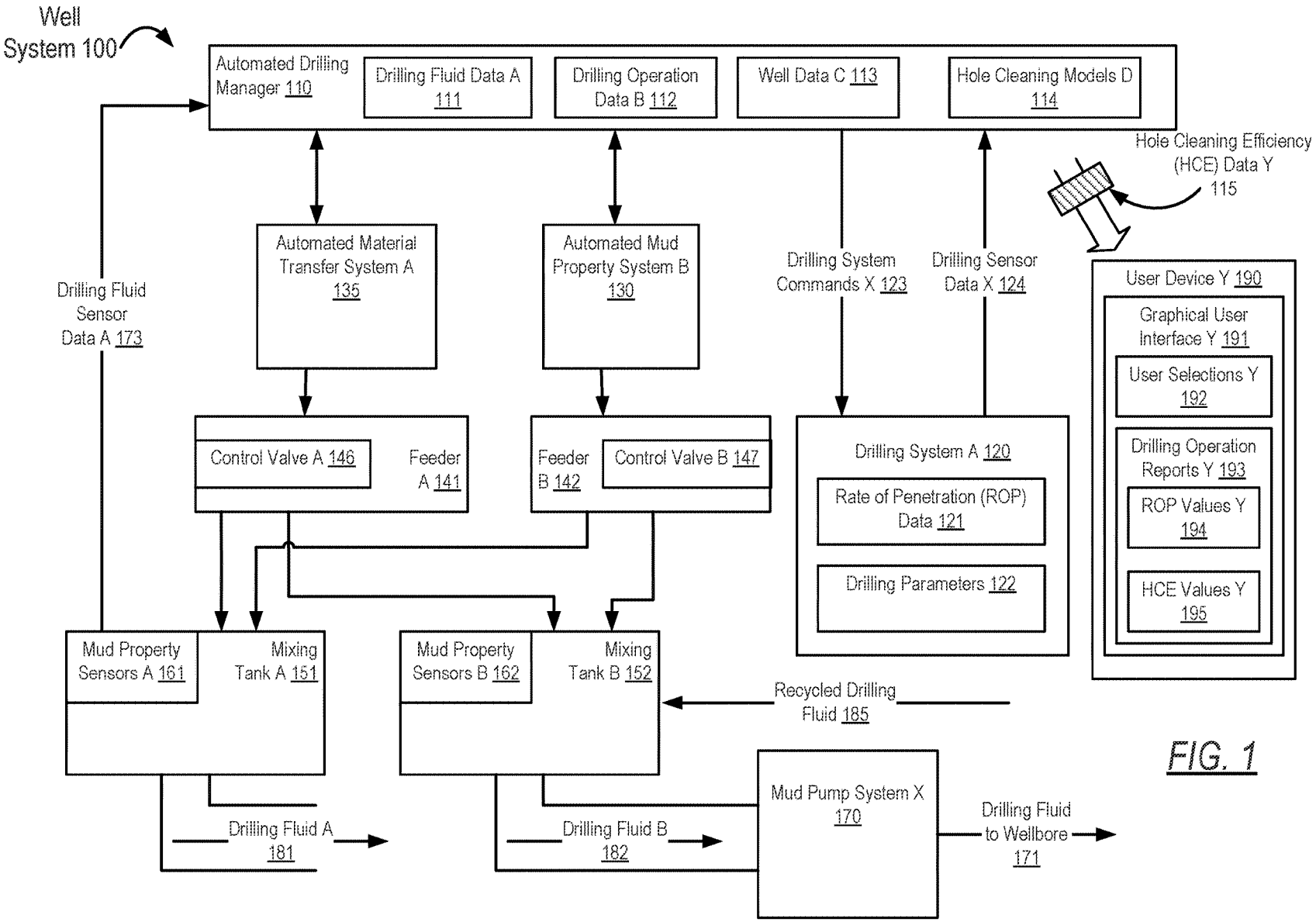
FIGS. 1, 2, and 3 show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for automating various hole cleaning operations. In some embodiments, for example, an automated drilling manager may provide a user interface that manages and controls drilling fluid processes and drilling operations that directly affect the hole cleaning state of a wellbore. This automated drilling manager may collect real-time data, such as drilling fluid data and drilling operation data, to determine hole cleaning efficiency (HCE) values that describe different hole cleaning states. More specifically, a hole cleaning model may be used with a variety of parameters that affect the HCE values. In contrast to some previous hole cleaning models, some hole cleaning models are contemplated that use drilling parameters, hole geometry, and fluid rheology in addition to equivalent circulation density (ECD) values to determine the corresponding HCE values. Thus, real-time changes to hole cleaning efficiency may be detected based on changes within a drilling operation, e.g., as a wellbore passes through different formations in the subsurface. Likewise, by detecting the current hole cleaning state of a wellbore in real-time, retreatment operations may be also be automated, e.g., by adjusting various drilling fluid properties to account for changes in cutting particle sizes.

Furthermore, inefficient removal of drilled cuttings may result in many problems for a drilling operation. For example, potential problems may include early drill bit wear, slow drilling rates, poor cementing operations, and even stuck pipe risks that may lead to complete loss of a well. By automating the hole cleaning process, an automated drilling manager may reduce the stuck-pipe risks and alert control systems and human personnel to dangers before a hole cleaning state becomes critical for a drilling operation. Therefore, hole cleaning efficiency may become a significant aspect for optimizing a drilling operation.

Turning to FIG. 1, FIG. 1 shows a schematic diagram in accordance with one or more embodiments. As shown in FIG. 1, FIG. 1 illustrates a well system (100) that may include an automated drilling manager (e.g., automated drilling manager (110)) coupled to one or more user devices (e.g., user device (190)), a drilling system (e.g., drilling system A (120)), a mud pump system (e.g., mud pump system X (170)), an automated material transfer system (e.g., automated material transfer system A (135)), an automated mud property system (e.g., automated mud property system B (130)), and various drilling fluid processing components. For example, drilling fluid processing equipment may include one or more feeders (e.g., feeder A (141), feeder B (142)), one or more control valves (e.g., control valve A (146), control valve B (147)), one or more mixing tanks (e.g., mixing tank A (151), mixing tank B (152)), and a solid removal system. An automated mud property system may include hardware and/or software that includes functionality for monitoring and/or controlling various chemical components used to produce drilling fluid. Likewise, the automated drilling manager may include hardware and/or software for monitoring and/or controlling one or more drilling operations performed by a drilling system.

With respect to the drilling system, drilling fluid may circulate through a drill string for continuous drilling, e.g., drilling fluid A (181) and drilling fluid B (182) as shown in FIG. 1, in order to circulate through a wellbore (e.g., drilling fluid to wellbore (171)). In particular, the ability of the drilling fluid to carry drilled cuttings from a wellbore may be governed by several factors that relate to various drilling fluid properties (e.g., mud rheology, mud weight, etc.) and various drilling operation parameters (e.g., drilling parameters (122)) such as drill pipe rotary speed (RPM), pipe eccentricity (i.e. axial location of the drill pipe), hole inclination angle, rate of penetration (ROP) (e.g., with respect to ROP data (121)). Likewise, used drilling fluid from a wellbore may be passed through a solid removal system prior to entering a mixing tank or being sent to a mud pump system. More specifically, a solid removal system may include equipment and other hardware for removing particular solids, such as drill cuttings and coarse aggregates, from used drilling fluid in order to recycle drilling fluid (e.g., recycled drilling fluid (185)). For more information on drilling systems, see FIG. 2 and the accompanying description below.

In some embodiments, an automated drilling manager includes functionality for using one or more hole cleaning models (e.g., hole cleaning models D (114)) to determine one or more hole cleaning efficiency (HCE) values. For example, a hole cleaning model may describe how drilling fluids under various laminar-flow regimes remove cuttings produced from drilling. As such, a hole cleaning model may characterize hole cleaning efficiency in the eccentric annuli of extended-reach well bores, evaluate drilling fluid performance, and/or predict various fluid rheological properties for optimum cleaning. Accordingly, hole cleaning models may be used in prewell planning as well as analyzing the cleaning state of a wellbore in real-time. Thus, efficient hole cleaning may affect the quality of directing and extended-reach drilling operations.

In some embodiments, an HCE value is determined using drilling fluid data (e.g., drilling fluid data A (111)), drilling operation data (e.g., drilling operation data B (112)), and/or well data (e.g., well data C (113)). Drilling fluid data may include values for various rheological and rheological-related parameters, such as plastic viscosity (PV) data, yield point (YP) data, fluid flow rate data, funnel viscosity data, mud weight values, and equivalent circulating density of an annulus (ECD) values. Drilling operation data may include rate of penetration (ROP) of a drill string, average cutting size, cutting particle sizes, etc. Well data may include hole inclination data, pipe diameter data, etc. Likewise, HCE values may be associated with different thresholds for describing various cleaning states of a well. In some embodiments, an automated drilling manager may use this aggregated drilling operation data, well data, and drilling fluid data to merge analytical operations with a drilling simulator or well control simulator for understanding how the downhole environment changes while drilling. For more information on hole cleaning models and HCE values, see Block 430 in FIG. 4 and the accompanying description below.

In some embodiments, an automated drilling manager transmits one or more commands (e.g., drilling system commands X (123)) to various control systems in a well system (e.g., drilling system A (120), automated material transfer system A (135), automated mud property system B (130)) in order to produce drilling operations with specific drilling parameters and/or produce drilling fluids (e.g., drilling fluid A (181), drilling fluid B (182), recycled drilling fluid (185)) having specific drilling fluid properties. Commands may include data messages transmitted over one or more network protocols using a network interface, such as through wireless data packets. Likewise, a command may also be a control signal, such as an analog electrical signal, that triggers one or more operations in a particular control system (e.g., drilling system A (120)).

Furthermore, drilling fluid data (e.g., drilling fluid data A (111)) may correspond to different physical qualities associated with drilling mud, such as specific gravity values (also referred to as mud weight or mud density), viscosity levels, pH levels, rheological values such as flow rates, temperature values, resistivity values, mud mixture weights, mud particle sizes, and various other attributes that affect the role of drilling fluid in a wellbore. For example, a drilling fluid property may be selected by a user device to have a desired predetermined rheological value, which may include a range of acceptable values, a specific threshold value that should be exceeded, a precise scalar quantity, etc. As such, an automated drilling manager or another control system may obtain sensor data (e.g., drilling fluid sensor data A (173)) from various mud property sensors (e.g., mud property sensors A (161), mud property sensors B (162)) regarding various drilling fluid property parameters. Examples of mud property sensors include pH sensors, density sensors, rheological sensors, volume sensors, weight sensors, flow meters, such as an ES flow sensor, etc. Likewise, sensor data may refer to both raw sensor measurements and/or processed sensor data associated with one or more drilling fluid properties.

With respect to mud pump systems, a mud pump system (e.g., mud pump system X (170)) may include hardware and software with functionality for supplying drilling fluid to a wellbore at one or more predetermined pressures and/or at one or more predetermined flow rates. For example, a mud pump system may include one or more displacement pumps that inject the drilling fluid into a wellbore. Likewise, a mud pump system may include a pump controller that includes hardware and/or software for adjusting local flow rates and pump pressures, e.g., in response to a command from an automated drilling manager or other control system. For example, a mud pump system may include one or more communication interfaces and/or memory for transmitting and/or obtaining data over a well network. A mud pump system may also obtain and/or store sensor data from one or more sensors coupled to a wellbore regarding one or more pump operations. While a mud pump system may correspond to a single pump, in some embodiments, a mud pump system may correspond to multiple pumps.

With respect to a mixing tanks, a mixing tank may be a container or other type of receptacle (e.g., a mud pit) for mixing various liquids, fresh mud, recycled mud (e.g., recycled drilling fluid (185)), additives, and/or other chemicals to produce a particular type of drilling fluid (e.g., drilling fluid A (181), drilling fluid B (182)). For example, a mixing tank may be coupled to one or more mud supply tanks, one or more additive supply tanks, one or more dry/wet feeders (e.g., feeder A (141), feeder B (142)), and one or more control valves (e.g., control valve A (146), control valve B (147)) for managing the mixing of chemicals within a respective mixing tank. Control valves may be used to meter chemical inputs into a mixing tank, as well as release drilling fluid into a mixing tank. Likewise, a mixing tank may include and/or be coupled to various types of drilling fluid equipment not shown in FIG. 1, such as various mud lines, liquid supply lines, and/or other mixing equipment.

In some embodiments, a well system includes an automated material transfer system (e.g., automated material transfer system A (135)). In particular, an automated material transfer system may be a control system with functionality for managing supplies of bulk powder and other inputs for producing a preliminary mud mixture. For example, an automated material transfer system may include a pneumatic, conveyer belt or a screw-type transfer system (e.g., using a screw pump) that transports material from a supply tank upon a command from a sensor-mediated response. Thus, the automated material transfer system may monitor a mixing tank using weight sensors and/or volume sensors to meter a predetermined amount of bulk powder to a selected mixing tank.

Likewise, a well system may also include an automated mud property system (e.g., automated mud property system B (130)) to control the supply of various additives to a mixing tank. In some embodiments, for example, an automated mud property system may include hardware and/or software with functionality for automatically supplying and/or mixing weighting agents, buffering agents, rheological modifiers, and/or other additives until a mud mixture matches and/or satisfies one or more desired drilling fluid properties. Examples of weighting agents may include barite, hematite, calcium carbonate, siderite, etc. A buffering agent may be a pH buffering agent that causes a mud mixture to resist changes in pH levels. For example, a buffering agent may include water, a weak acid (or weak base) and salt of the weak acid (or a salt of weak base). Rheological modifiers may include drilling fluid additives that adjust one or more flow properties of a drilling fluid. One type of rheological modifier is a viscosifier, which may be an additive with functionality for providing thermal stability, hole-cleaning, shear-thinning, improving carrying capacity as well as modifying other attributes of a drilling fluid. Examples of viscosifiers include bentonite, inorganic viscosifiers, polymeric viscosifiers, low-temperature viscosifiers, high-temperature viscosifiers, oil-fluid liquid viscosifiers, organophilic clay viscosifiers, and biopolymer viscosifiers.

Furthermore, an automated drilling manager may monitor various drilling fluid properties and drilling parameters in real-time. For example, drilling fluid properties may be monitored using one or more mud property sensors. Likewise, drilling parameters may be modified in real-time based on downhole sensors, drilling sensors (e.g., using drilling sensor data X (124)), etc. In some embodiments, for example, the automated drilling manager modifies drilling fluid properties and drilling parameters at predetermined intervals until user-defined properties are achieved by the well system (100). The user-defined properties may correspond to a selection by a user device (e.g., user selection Y (192) obtained by user device (190) using a graphical user interface Y (191)). For example, an automated drilling manager may be coupled to a user device e.g., over a well network, or remotely (e.g., through a remote connection using Internet access or a wireless connection at a well site). Based on real-time updates received for a current drilling operation, a user and/or the automated drilling manager may modify previously-selected drilling fluid property values and/or drilling parameters, e.g., in response to changes in drilling fluid within the wellbore.

Keeping with FIG. 1, an automated drilling manager, an automated material transfer system, and/or an automated mud property system may include one or more control systems that include one or more programmable logic controllers (PLCs). Specifically, a programmable logic controller may control valve states, fluid levels, pipe pressures, warning alarms, and/or pressure releases throughout a well system. In particular, a programmable logic controller may be a ruggedized computer system with functionality to withstand vibrations, extreme temperatures, wet conditions, and/or dusty conditions, for example, around a drilling rig. In some embodiments, the automated drilling manager (110), the automated material transfer system A (135), the automated mud property system B (130), and/or the user device (190) may include a computer system that is similar to the computer system (702) described below with regard to FIG. 7 and the accompanying description.

Figure 2:
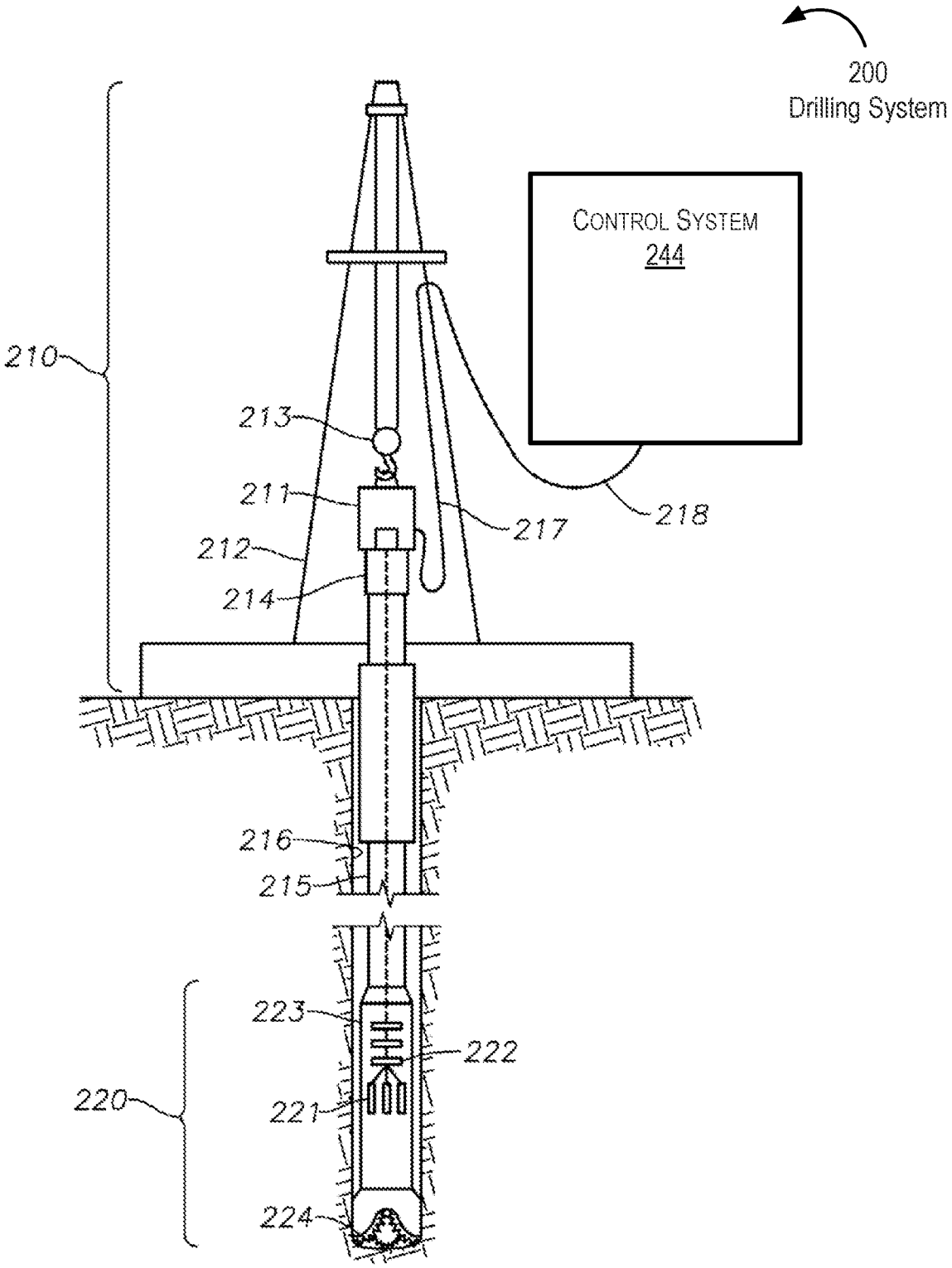

Turning to FIG. 2, FIG. 2 illustrate systems in accordance with one or more embodiments. As shown in FIG. 2, a drilling system (200) may include a top drive drill rig (210) arranged around the setup of a drill bit logging tool (220). A top drive drill rig (210) may include a top drive (211) that may be suspended in a derrick (212) by a travelling block (213). In the center of the top drive (211), a drive shaft (214) may be coupled to a top pipe of a drill string (215), for example, by threads. The top drive (211) may rotate the drive shaft (214), so that the drill string (215) and a drill bit logging tool (220) cut the rock at the bottom of a wellbore (216). A power cable (217) supplying electric power to the top drive (211) may be protected inside one or more service loops (218) coupled to a control system (244). As such, drilling fluid may be pumped into the wellbore (216) using the drive shaft (214) and/or the drill string (215). Likewise, the drilling system may also include a mud pump, a mud line, mud pits, a mud return, and other components related to the circulation or recirculation of drilling fluid within the wellbore (216). The control system (244) may be similar to various control systems described above in FIG. 1 and the accompanying description, such as the automated drilling manager (110), the automated material transfer system A (135) and/or the automated mud property system B (130).

Moreover, when completing a well, casing may be inserted into the wellbore (216). The sides of the wellbore (216) may require support, and thus the casing may be used for supporting the sides of the wellbore (216). As such, a space between the casing and the untreated sides of the wellbore (216) may be cemented to hold the casing in place. The cement may be forced through a lower end of the casing and into an annulus between the casing and a wall of the wellbore (216). More specifically, a cementing plug may be used for pushing the cement from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

As further shown in FIG. 2, sensors (221) may be included in a sensor assembly (223), which is positioned adjacent to a drill bit (224) and coupled to the drill string (215). Sensors (221) may also be coupled to a processor assembly (223) that includes a processor, memory, and an analog-to-digital converter (222) for processing sensor measurements. For example, the sensors (221) may include acoustic sensors, such as accelerometers, measurement microphones, contact microphones, and hydrophones. Likewise, the sensors (221) may include other types of sensors, such as transmitters and receivers to measure resistivity, gamma ray detectors, etc. The sensors (221) may include hardware and/or software for generating different types of well logs (such as acoustic logs or density logs) that may provide well data about a wellbore, including porosity of wellbore sections, gas saturation, bed boundaries in a geologic formation, fractures in the wellbore or completion cement, and many other pieces of information about a formation. If such well data is acquired during drilling operations (i.e., logging-while-drilling), then the information may be used to make adjustments to drilling operations in real-time. Such adjustments may include rate of penetration (ROP), drilling direction, altering mud weight, and many others drilling parameters.

In some embodiments, acoustic sensors may be installed in a drilling fluid circulation system of a drilling system (200) to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, casing shoe positioning, etc.

The control system (244) may be coupled to the sensor assembly (223) in order to perform various program functions for up-down steering and left-right steering of the drill bit (224) through the wellbore (216). More specifically, the control system (244) may include hardware and/or software with functionality for geosteering a drill bit through a formation in a lateral well using sensor signals, such as drilling acoustic signals or resistivity measurements. For example, the formation may be a reservoir region, such as a pay zone, bed rock, or cap rock.

Turning to geosteering, geosteering may be used to position the drill bit (224) or drill string (215) relative to a boundary between different subsurface layers (e.g., overlying, underlying, and lateral layers of a pay zone) during drilling operations. In particular, measuring rock properties during drilling may provide the drilling system (200) with the ability to steer the drill bit (224) in the direction of desired hydrocarbon concentrations. As such, a geo steering system may use various sensors located inside or adjacent to the drilling string (215) to determine different rock formations within a well path. In some geosteering systems, drilling tools may use resistivity or acoustic measurements to guide the drill bit (224) during horizontal or lateral drilling.

In some embodiments, a user device (e.g., user device Y (190) may provide a graphical user interface (e.g., graphical user interface Y (191)) for communicating with an automated drilling manager, e.g., to monitor drilling operations, drilling fluid operations, and hole cleaning efficiency data (e.g., HCE data Y (115)). For example, a user device may be a personal computer, a human-machine interface, a smartphone, or another type of computer device for presenting information and obtaining user inputs in regard to the presented information. Likewise, the user device may obtain various user selections (e.g., user selections Y (192)) in regard to drilling operations, drilling fluid operations, and/or hole cleaning operations. Likewise, the user device may display various reports that may include charts as well as other arrangements of well data (e.g., drilling operation reports Y (193) includes ROP values Y (194) and HCE values Y (195)).

Figure 3:
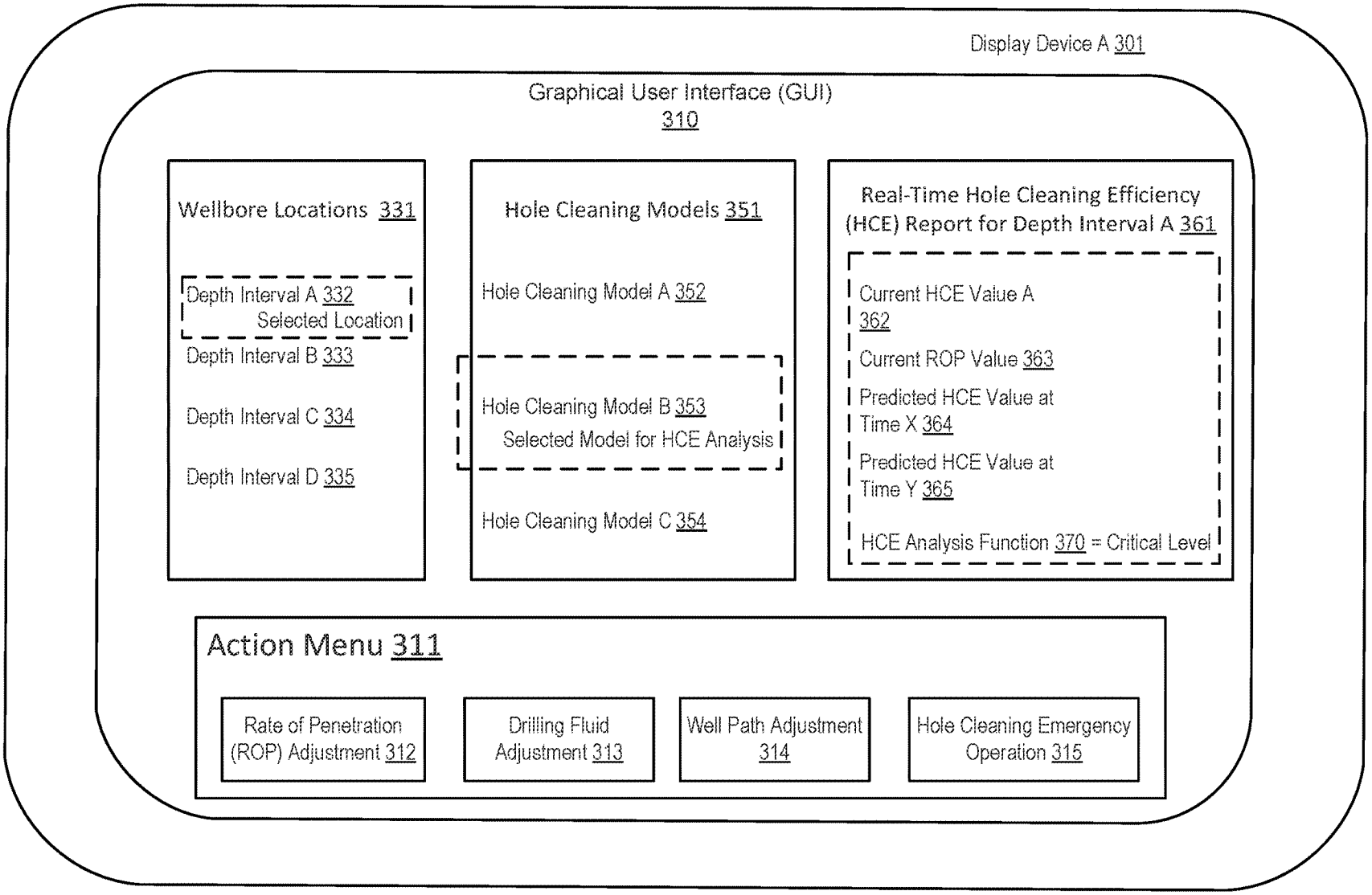

Turning to FIG. 3, FIG. 3 illustrates an example of monitoring hole cleaning states at various depth intervals of a wellbore and through a user interface in accordance with one or more embodiments. In FIG. 3, a graphical user interface (GUI) (310) is provided on a display device A (301) of a user device (not shown). As shown in FIG. 3, the GUI (310) may provide information regarding various well locations (331) of a particular wellbore (e.g., depth interval A (332), depth interval B (333), depth interval C (334), depth interval D (335)). Thus, a user may select depth interval A (232) and then one of the hole cleaning models (351) (e.g., hole cleaning model A (352), hole cleaning model B (353), hole cleaning model C (354)), through the GUI (310) in order to perform one or more HCE analyses. Accordingly, in response to a user selecting an analysis based on the hole cleaning model B (353), an automated drilling manager may generate a real-time HCE report (361) for depth interval A (332). In the real-time HCE report (361), the GUI (310) displays a current HCE value A (362) with respect to a current ROP value (363), as well as predicted HCE values (364, 365), at times X and Y, respectively.

Based on this HCE data, an automated drilling manager may perform an HCE analysis function (370). In this example, the HCE analysis function (370) determines that the current and predicted HCE values (362, 364, 365) indicate a critical level of a hole cleaning state of the wellbore.

Keeping with FIG. 3, in some embodiments, an automated drilling manager provides an action menu (311) to a user for selecting one or more commands based on an HCE analysis or other HCE information. For example, the action menu (311) may be a GUI window that automatically provides various recommendation options based on various predetermined criteria. In particular, the GUI (310) may provide commands to perform a ROP adjustment (312), a drilling fluid adjustment (313), a command to perform a well path adjustment (314), or a hole cleaning emergency operation (315). Likewise, should the wellbore enter a very problematic cleaning state, a user may also trigger a hole cleaning emergency operation, e.g., to address any possible stuck pipe risks.

While FIGS. 1, 2, and 3 shows various configurations of components, other configurations may be used without departing from the scope of the disclosure. For example, various components in FIGS. 1, 2, and 3 may be combined to create a single component. As another example, the functionality performed by a single component may be performed by two or more components.

Figure 4:
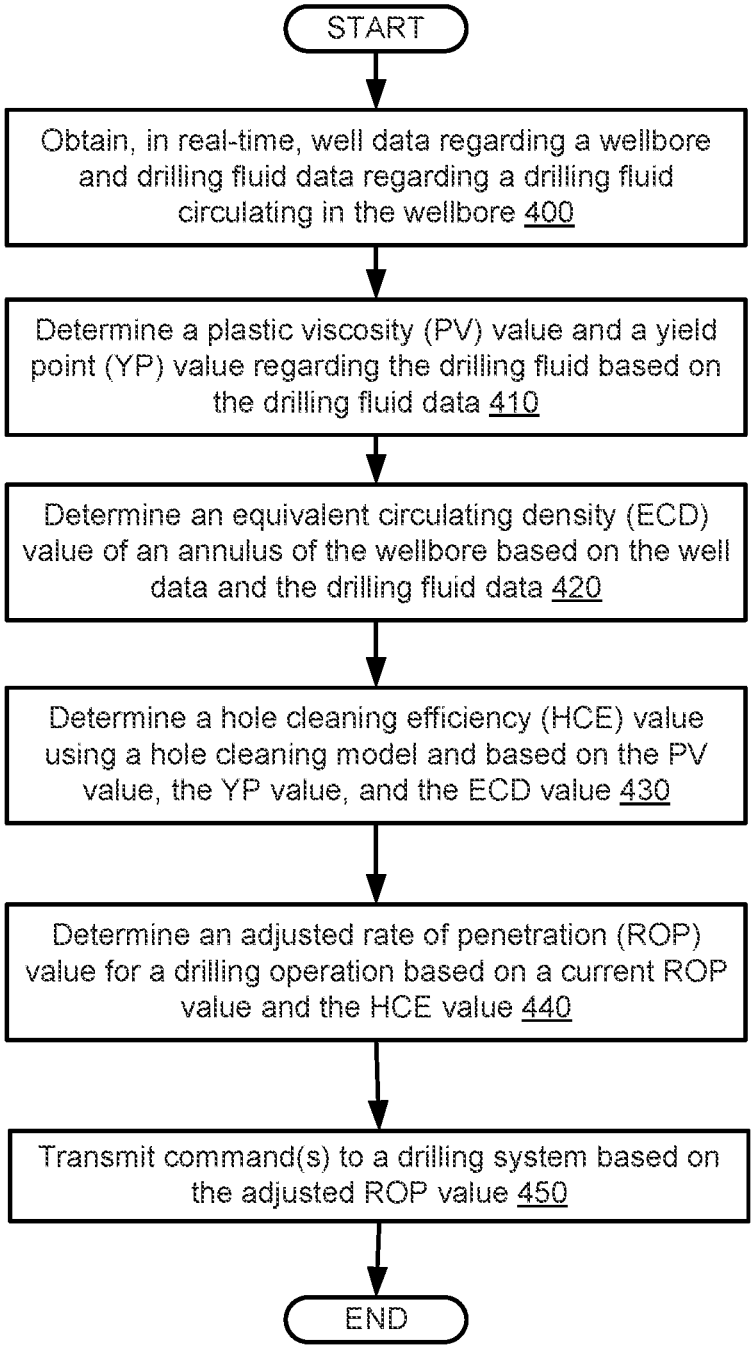
FIG. 4 shows a flowchart in accordance with one or more embodiments.

Turning to FIG. 4, FIG. 4 shows a flowchart in accordance with one or more embodiments. Specifically, FIG. 4 describes a general method for managing drilling fluid based on a hole cleaning model. One or more blocks in FIG. 4 may be performed by one or more components (e.g., automated drilling manager (110)) as described in FIGS. 1, 2, and 3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 400, well data regarding a wellbore and drilling fluid data regarding a drilling fluid circulating in the wellbore is obtained in real-time in accordance with one or more embodiments. For example, an automated drilling manager may collect data from various sensors throughout a well site, e.g., from drilling fluid processing equipment as well as downhole in a wellbore.

In Block 410, a plastic viscosity (PV) value and a yield point (YP) value are determined regarding a drilling fluid based on drilling fluid data in accordance with one or more embodiments.

In Block 420, an equivalent circulating density (ECD) value of an annulus of a wellbore is determined based on well data and drilling fluid data in accordance with one or more embodiments. One or more ECD values may be determined in accordance with one or more embodiments described in the below section titled Equivalent Circulating Density of Drilling Fluid and the accompanying description.

In Block 430, a hole cleaning efficiency (HCE) value is determined using a hole cleaning model and based on a PV value, a YP value, and an ECD value in accordance with one or more embodiments. In some embodiments, a hole cleaning model is based on a cutting carrying index (CCI) that describes how clean is a wellbore. As such, a hole cleaning model may use similar classification ranges as CCI, which may include two ranges: (1) if CCI>1 where the hole cleaning state is in a good condition; and (2) if CCI≤0.5, the hole cleaning state is in a bad condition (e.g., and thus ROP may need to be decreased). In some embodiments, for example, a CCI value may be expressed using the following Equation 1:

$$CCI = \frac{k \times AV \times M_{wt}}{400000} \quad \text{Equation 1}$$

where k corresponds to a power law constant. The power law constant k may be expressed using the following Equation 2:

$$k=(PV+YP)(511)^{1-n} \quad \text{Equation 2}$$

where, PV denotes the drilling fluid plastic viscosity (e.g., cP measurements), YP is the drilling fluid yield point (e.g., lb/100 ft2 measurements), and n is the flow behavior index. The flow behavior index n may be a function of the drilling fluid plastic viscosity and yield point as expressed using the following Equation 3

$$n = 3.322 \log\left(\frac{2PV + YP}{PV + YP}\right) \quad \text{Equation 3}$$

By substituting Equations 2 and 3 into Equation 1, for example, a hole cleaning efficiency (HCE) parameter may be determined based on the cutting concentration index. In some embodiments, for example, the HCE parameter may be expressed using the following Equation 4 that is based on Equations 1, 2, and 3:

$$CCI = \frac{(PV + YP)(511)^{1-\left[3.322\log\left(\frac{2PV+YP}{PV+YP}\right)\right]} \times AV \times M_{wt}}{400000} \quad \text{Equation 4}$$

where AV is an annulus velocity, and $M_{wt}$ is a drilling fluid density or a mud weight. The annulus velocity may be a drilling parameter based on a minimum velocity $V_{min}$ required to lift the cuttings while drilling. As such, the minimum velocity $V_{min}$ may be the summation of a cuttings velocity $V_{cut}$ and a slip velocity $V_{slip}$ as expressed in the following Equation 5:

$$AV=V_{min}=V_{cut}+V_{slip} \quad \text{Equation 5}$$

The cuttings velocity $V_{cut}$ may describe a cuttings transport through a wellbore and be measured in ft/min. For example, the cuttings velocity $V_{cut}$ may be expressed using the following Equation 6:

$$V_{cut} = \frac{ROP}{36\left[1 - \left(\frac{D_{pipe}}{D_{hole}}\right)^2\right] \times 0.01778ROP + 0.505} \quad \text{Equation 6}$$

where $D_{pipe}$ and $D_{hole}$ denote the drill pipe size and drilled hole size, respectively, both in inches, Furthermore the cuttings slip velocity $V_{slip}$ may describe a minimum flow rate required to clean a wellbore. In some embodiments, the cuttings slip velocity $V_{slip}$ may be expressed using the following Equation 7:

$$V_{slip}=(C_{ang})(C_{size})(C_{mwt})\overline{V}_{slip} \quad \text{Equation 7}$$

where $C_{ang}$ corresponds to a hole correction factor, $C_{size}$ corresponds to a particle size correction factor, and $C_{mwt}$ corresponds to a mud weight correction factor. $\overline{V}_{slip}$ may be based on a drilling fluid apparent viscosity $\mu_a$. For example, $\overline{V}_{slip}$ may be expressed using the following Equation 8:

$$\overline{V}_{slip}=0.00516\mu_a+3.006 \quad \text{Equation 8}$$

The correction factors $C_{ang}$, $C_{size}$, and $C_{mwt}$ may be expressed using the following Equations 9, 10, and 11:

$$C_{ang}=00342\theta_{ang}-0.000233\theta_{ang}^{2}-0.213 \quad \text{Equation 9}$$

$$C_{size}=-1.04D_{50cut}+1.286 \quad \text{Equation 10}$$

$$C_{mwt}=1-0.0333(M_{mt}-8.7) \quad \text{Equation 11}$$

where $\theta_{ang}$ corresponds to the hole inclination (e.g., in degrees), and $D_{50cut}$ is the average particle size (e.g., in microns).

By replacing the mud weight ($M_{wt}$) in Equation 4 and Equation 11 by the equivalent circulating density in the annulus (ECD), and substituting for the values from Equations 5 to 11 into Equation 4, an HCE parameter value may be determined using the following Equation 12:

$$HCE = \frac{X[Y+Z]ECD}{6666.7} \quad \text{Equation 12}$$

where the parameters X, Y, and Z may be expressed using the following Equations 13, 14, and 15:

$$X = (PV+YP)(511)^{1-\left[3.322\log\left(\frac{2PV+YP}{PV+YP}\right)\right]} \quad \text{Equation 13}$$

$$Y = \frac{ROP}{36\left[1-\left(\frac{D_{pipe}}{D_{hole}}\right)^2\right]\times 0.01778\,ROP+0.505} \quad \text{Equation 14}$$

$$Z = (0.00516\mu_a+3.006)\left(0.0342\theta_{ang}-0.000233\theta_{ang}^2-0.213\right) \quad \text{Equation 15}$$

$$(-1.04D_{50cut}+1.286)(1-0.0333[ECD-8.7])$$

Figure 5:
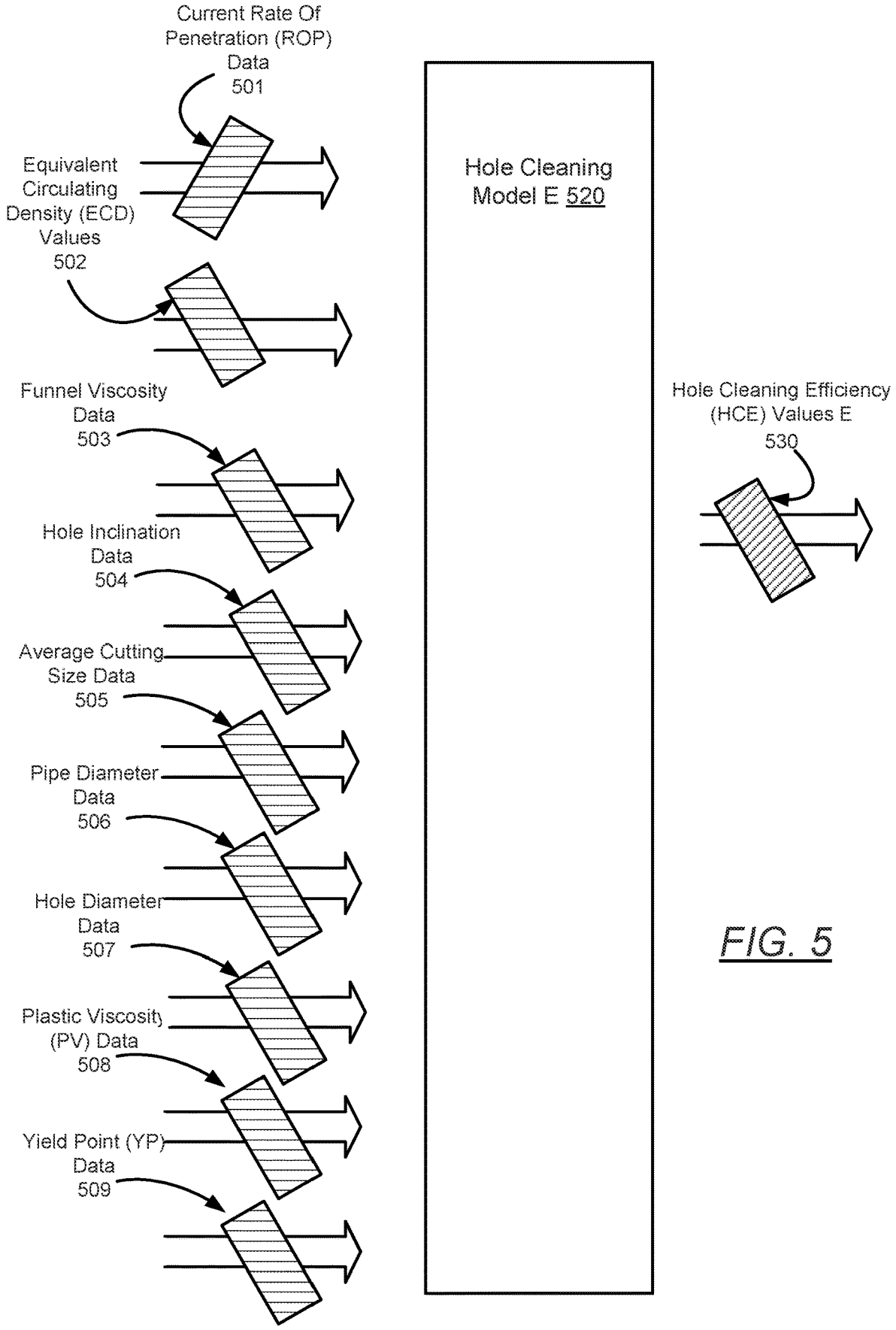

Turning to FIG. 5, FIG. 5 provides an example of determining an HCE value in accordance with one or more embodiments. The following example is for explanatory purposes only and not intended to limit the scope of the disclosed technology. In FIG. 5, a hole cleaning model E (520) obtains various inputs based on drilling fluid data (i.e., ECD values (502), funnel viscosity data (503), average cutting size data (505), PV data (508), YP data (509)) and drilling operation data (i.e., current ROP data (501), hole inclination data (504), pipe diameter data (506), hole diameter data (507)). For example, the drilling fluid data may be obtained by an automated drilling manager from various mud property sensors as well as from various control systems throughout a well system. Likewise, the drilling operation data may be collected from drilling sensor signals as well as user inputs, e.g., from a well path design for a drilling operation. Based on these inputs, the hole cleaning model E (520) may determine multiple HCE values (530) for analyzing the drilling fluid circulating through the wellbore as well as making adjustments to drilling parameters with respect to one or more drilling operations.

Figure 6A:
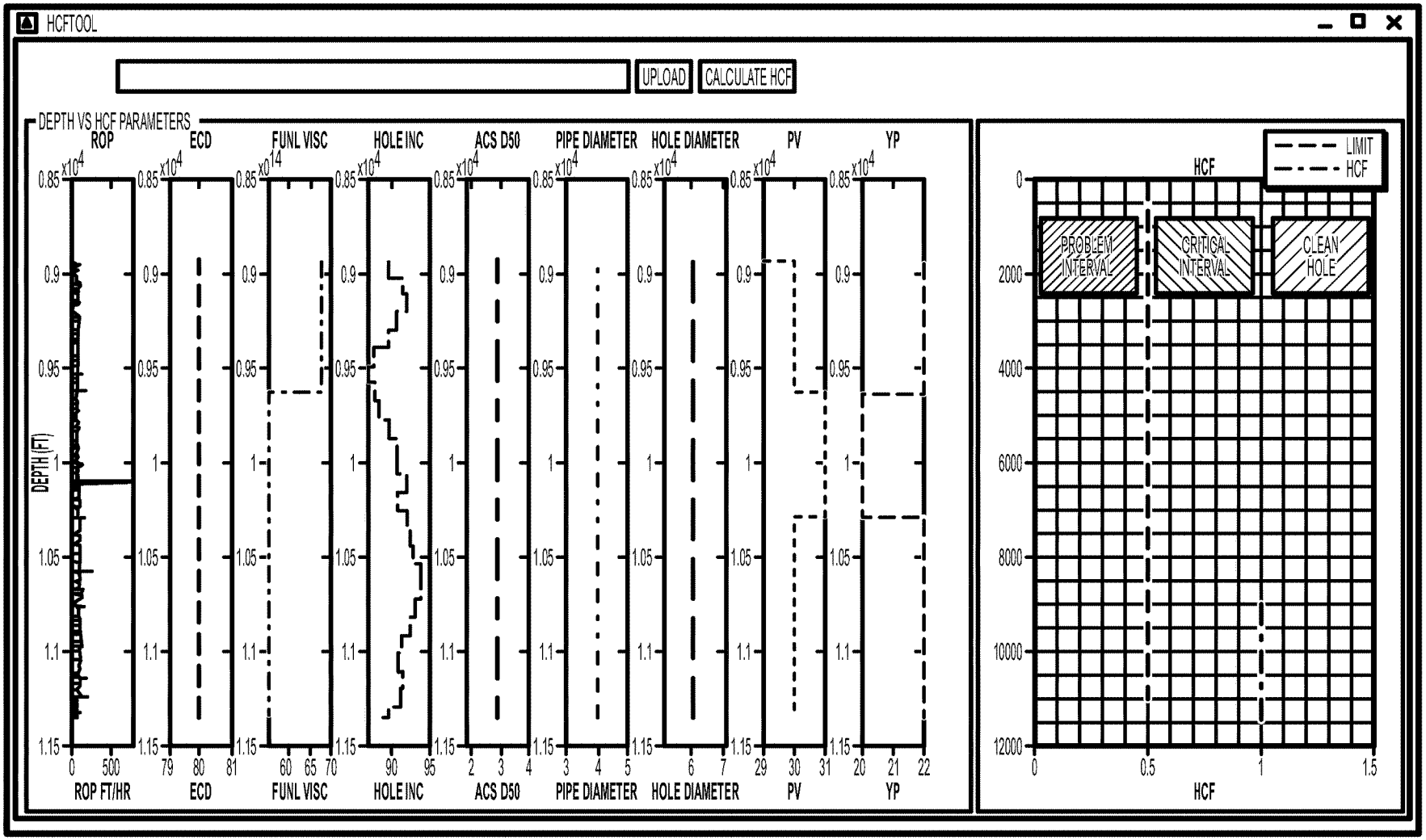
Figure 6B:
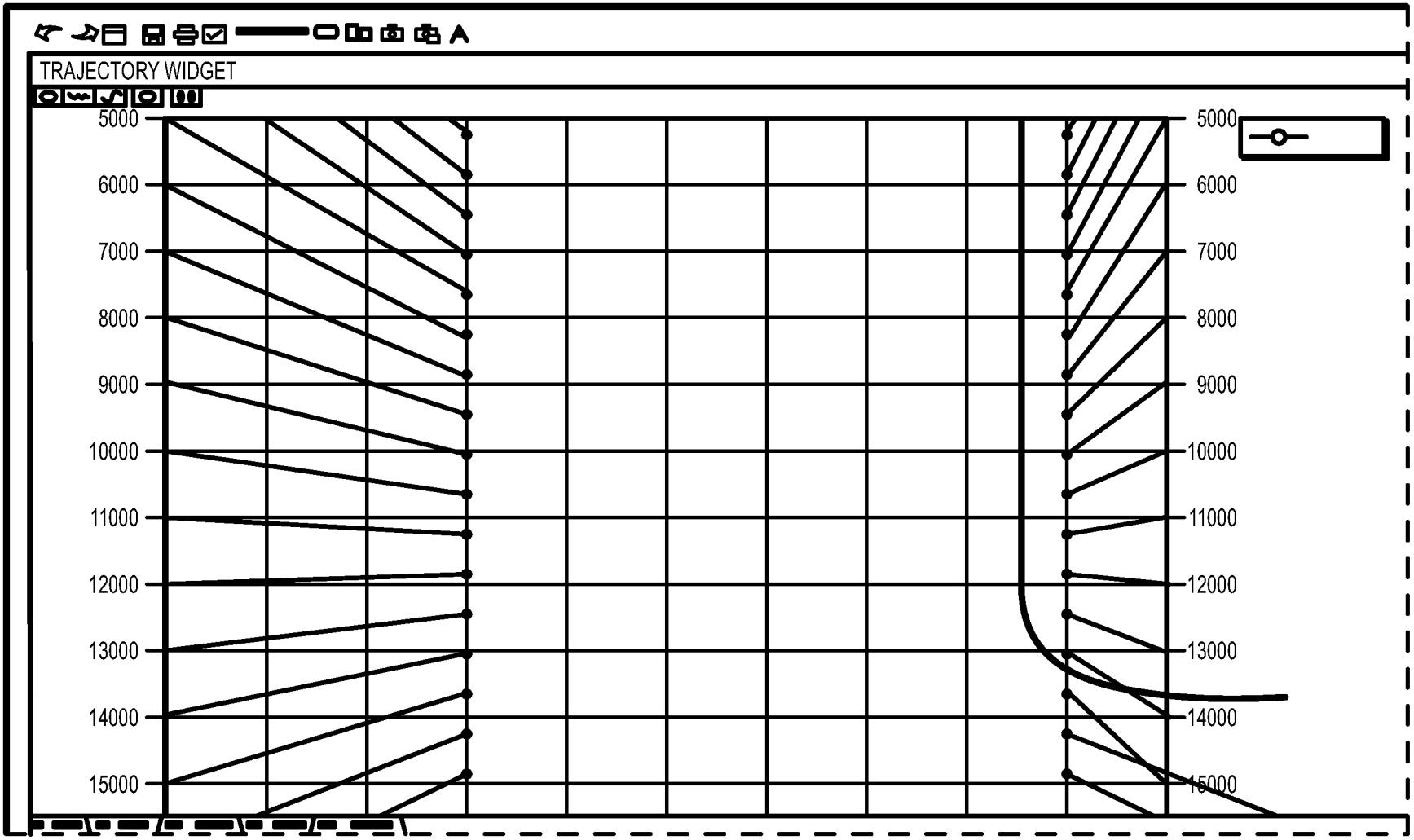
Figure 6D:
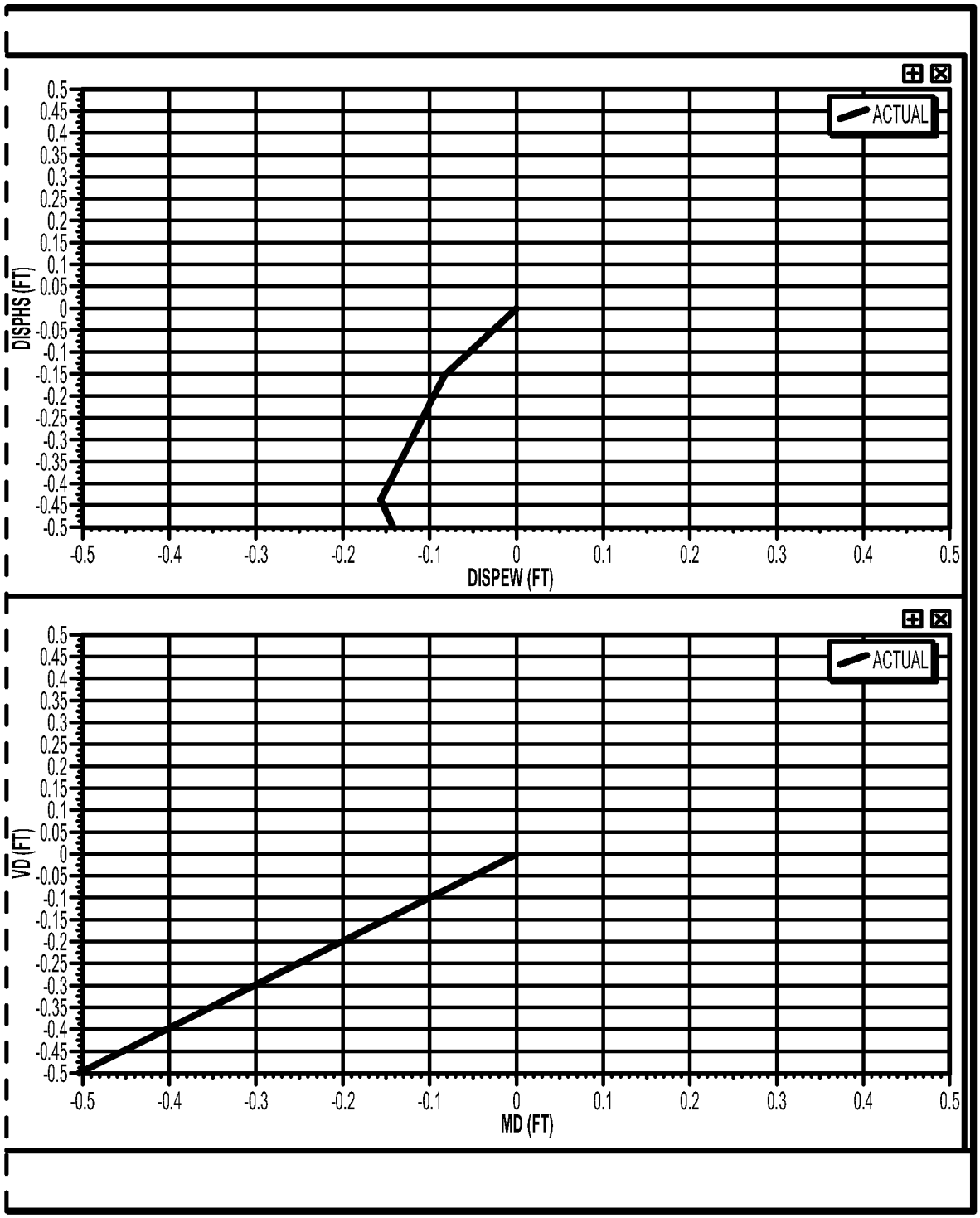

Returning to FIG. 4, in Block 440, an adjusted rate of penetration (ROP) value is determined for a drilling operation based on a current ROP value and an HCE value in accordance with one or more embodiments. For example, a user may select different ROP values to achieve different HCE values within a graphical user interface. This selection may be part of the request from a user device to adjust the current ROP value. In another example, a user device or a control system in a well system may automatically determine an adjusted ROP value that satisfies one or more drilling parameters in addition to a specified HCE value, e.g., based on a formation type or a particular well path design. For example, FIG. 6A shows a software application that collects drilling operation data and drilling fluid data with respect to depth in a drilling operation. As shown in FIG. 6A, an HCE analysis is illustrated on the farthest right of the graphical user interface for an analyzed hole section interval. FIGS. 6B, 6C, and 6D show an analyzed well trajectory with a hole section that has a 90-degree hole inclination within a graphical user interface (i.e., the segmented border lines illustrate the location of adjacent windows within the graphical user interface).

In some embodiments, an automated manager initiates an adjustment to current ROP value in response to determining that the current ROP values fails to satisfy one or more predetermined thresholds. Examples of predetermined thresholds may correspond to different ranges of HCE values that represent a clean hole (i.e., a clean hole threshold), a critical range approaching problems with a drilling operations (i.e., a critical interval threshold), and/or a problem range that corresponds to dangerous conditions for a drilling operations (i.e., a problem interval threshold).

In Block 450, one or more commands are transmitted to a drilling system based on an adjusted ROP value in accordance with one or more embodiments. In response to a user selection of an adjusted ROP value or a decision automatically made by an automated drilling manager, a command may be transmitted s to one or more components within a drilling system in order to achieve the adjusted ROP value.

Equivalent Circulating Density (ECD) of Drilling Fluid

During a drilling operation, a drilling system may determine, in real-time, the drilling fluid ECD. In some embodiments, the ECD may be calculated as the sum of a real-time drilling fluid density (which may also be referred to as an effective fluid density ($MW_{eff}$) or effective mud weight) and a density resulting from the friction pressure absorbed by a formation. The effective fluid density may be calculated based on a cuttings concentration in the annulus (CCA), which may be calculated using real-time values of drilling parameters. The real-time values of drilling parameters are obtained from logging and measuring tools, surface logs, and/or daily drilling reports. These drilling parameters may include the rate of penetration (ROP) of a drill bit, a hole size of a wellbore, and a flow rate of the mud pump. In an example, the CCA may be calculated using Equation 16:

$$CCA = \frac{ROP*\text{Hole } Size^2}{1471*GPM*TR}. \quad \text{Equation 16}$$

In Equation 16, "Hole Size" is the diameter of the wellbore (e.g., in feet), ROP is a rate of penetration (e.g., drilling rate, in feet/hour) of a drilling tool (for example, a drill bit), GPM is the flow rate (e.g., in gallons per minute) of the drilling fluid, and TR represents a transport ratio of the cuttings to the surface. In some embodiments, TR is approximated as a constant with a value of 0.55.

In an example, the effective fluid density may be calculated using Equation 17:

$$(MW_{eff})=(MW*CCA)+MW. \quad \text{Equation 17}$$

In Equation 17, $MW_{eff}$ is the effective drilling fluid density (e.g., in pounds per gallon (lb/gal)) and MW is the static drilling fluid density (that is, the drilling fluid density without any cuttings). As shown by Equation 17, the effective drilling fluid density accounts for the static drilling fluid density and the cuttings concentration.

Once the effective drilling fluid density is calculated, the ECD may be calculated using the effective drilling fluid density. In some embodiments, the ECD is calculated using Equation 18:

$$ECD = MWeff + \left(\left(\left(\frac{0.085}{OH - DP}\right)\left(YP + \frac{PVVann}{300(OH - DP)}\right)\right) 7.481\right). \quad \text{Equation 18}$$

In Equation 18, OH is an outer-hole diameter of a wellbore, DP is a diameter of a drill pipe of a drilling system, YP is a yield point of the drilling fluid, PV is a plastic viscosity of the drilling fluid, and $V_{ann}$ is an annular velocity of the drilling fluid.

In an example, based on an ECD value, the drilling system may determine a maximum rate of penetration for a drill bit. More specifically, the ECD, a pore pressure limit of the formation, and a fracture pressure limit of the formation are used to calculate the stability of the formation. Then, based on the calculated stability, the maximum rate of penetration may be calculated. Additionally, the drilling system may control the rate of penetration, perhaps to be less than the calculated maximum rate. Controlling the rate of penetration based on ECD values may allow a drilling system to: (i) avoid fracturing the formation while drilling, (ii) ensure smooth drilling with generated drilling cuttings, and (iii) avoid or mitigate stuck pipe incidents.

In another example, based on the current value of the ECD, the drilling system may adjust drilling parameters and/or drilling fluid parameters to produce a different ECD value. In one implementation, the drilling system adjusts the ECD by controlling a mud pump to increase or decrease the volume of drilling fluid pumped into the wellbore, thereby increasing or decreasing the effective drilling fluid density. Increasing the volume of drilling fluid decreases the drilling fluid density by dilution and decreasing the volume of drilling fluid increases the drilling fluid density. In another implementation, the drilling system adjusts an ECD value by increasing the drilling fluid density by adding a weighing agent to the drilling fluid. In yet another implementation, the drilling system adjusts the ECD by controlling one of the drilling pipe outer diameter, the yield point of the drilling fluid, the plastic viscosity of the drilling fluid, or the annular velocity of the drilling fluid.

Computer System

Figure 7:
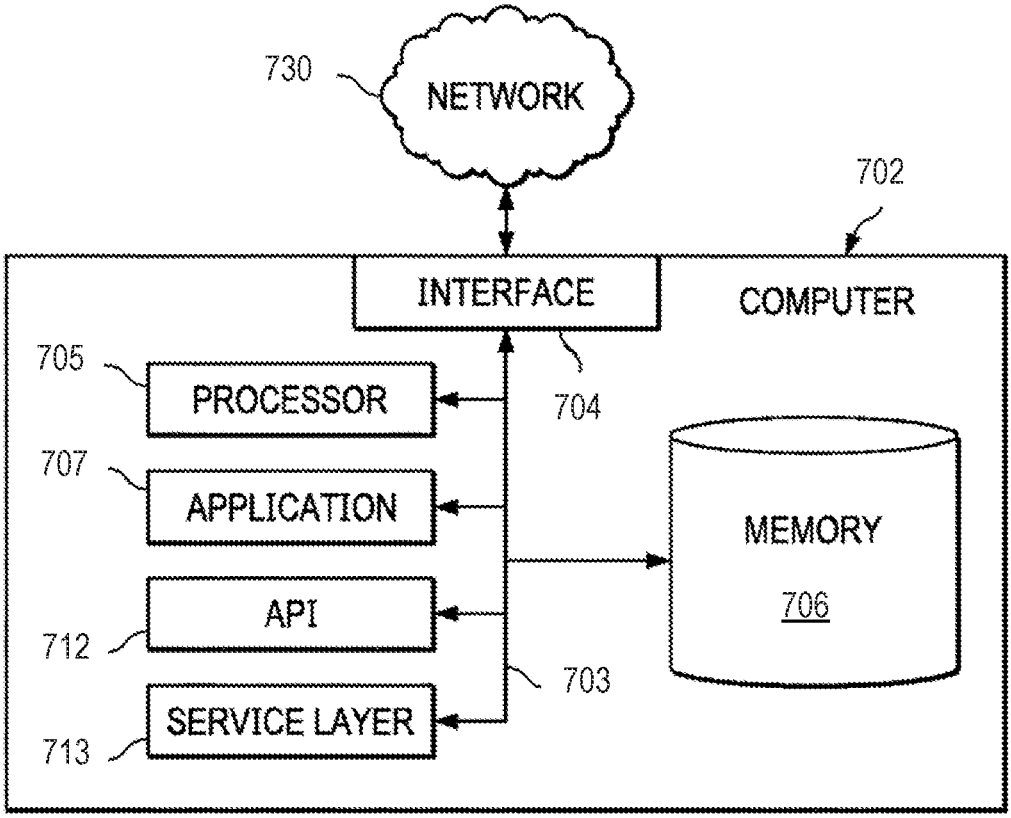
FIG. 7 shows a computer system in accordance with one or more embodiments.

Embodiments may be implemented on a computer system. FIG. 7 is a block diagram of a computer system (702) used to provide computational functionalities associated with described algorithms, methods, functions, processes, flows, and procedures as described in the instant disclosure, according to an implementation. The illustrated computer (702) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730) or cloud. In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) or cloud from a client application (for example, executing on another computer (702)) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or other suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 7, two or more interfaces (704) may be used according to particular needs, desires, or particular implementations of the computer (702). The interface (704) is used by the computer (702) for communicating with other systems in a distributed environment that are connected to the network (730). Generally, the interface (704 includes logic encoded in software or hardware (or a combination of software and hardware) and operable to communicate with the network (730) or cloud. More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 7, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 7, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), each computer (702) communicating over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

In some embodiments, the computer (702) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), artificial intelligence as a service (AIaaS), serverless computing, and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed:

1. A method, comprising:

obtaining, by a computer processor and in real-time, well data regarding a wellbore and drilling fluid data regarding drilling fluid circulating in the wellbore;

determining, by the computer processor and based on the drilling fluid data, a plastic viscosity (PV) value and a yield point (YP) value regarding the drilling fluid;

determining, by the computer processor and based on the well data and the drilling fluid data, an equivalent circulating density (ECD) value of an annulus of the wellbore;

determining, by the computer processor, a plurality of hole cleaning efficiency (HCE) values for a plurality of depth intervals in the wellbore based on a hole cleaning model, the PV value, the YP value, the ECD value, and a plurality of rate of penetration (ROP) values for a drilling operation in the wellbore, wherein the plurality of HCE values describe different hole cleaning states based on different rheological parameters of the drilling fluid in the wellbore;

presenting, by the computer processor and using a graphical user interface on a user device, the plurality of HCE values for the plurality of depth intervals in the wellbore;

determining, by the computer processor, a plurality of adjusted ROP values for the drilling operation in the wellbore based on the plurality of HCE values and a current ROP value;

obtaining, using the graphical user interface and in response to presenting the plurality of HCE values for the plurality of depth intervals, a user selection of an adjusted ROP value among the plurality of adjusted ROP values associated with the plurality of HCE values; and transmitting, by the computer processor and in response to obtaining the user selection of the adjusted ROP value, a command to a drilling system that produces the adjusted ROP value in the drilling operation.

2. The method of claim 1, further comprising:

determining a cuttings concentration in the annulus (CCA) value based on an ROP value, a hole size value, a flow rate value of the drilling fluid, and a transport ratio value; and determining an effective mud weight of the drilling fluid based on a static mud weight and the CCA value, wherein the ECD value is based on the effective mud weight, the PV value, and the YP value.

3. The method of claim 1, further comprising:

determining an annulus velocity (AV) value based on a cuttings velocity and a slip velocity, wherein the AV value corresponds to a minimum velocity required to lift cuttings during a drilling operation, wherein at least one HCE value among the plurality of HCE values is based on the AV value, the PV value, the YP value, and a mud weight value.

4. The method of claim 3, wherein the slip velocity is based on a hole inclination correction factor, a particle size correction factor, a mud weight correction factor, and a drilling fluid apparent viscosity.

5. The method of claim 1, determining whether a current HCE value among the plurality of HCE values satisfies a predetermined threshold, wherein the user selection is obtained in response to the current HCE value failing to satisfy the predetermined threshold.

6. The method of claim 5, wherein the predetermined threshold is selected from a group consisting of a clean hole threshold or a critical interval threshold.

7. The method of claim 1, wherein the drilling fluid data comprises a plurality of rheological values, one or more funnel viscosity values, and an average cutting size value, and wherein the well data corresponds to a plurality of well parameters comprising one or more hole inclination values, one or more pipe diameters, and one or more hole diameters.

8. The method of claim 1, further comprising:

obtaining, by a control system and from one or more mud property sensors, PV data and YP data regarding the drilling fluid; and obtaining, by the control system and from a mud pump system, flow rate data of the drilling fluid, wherein the control system determines at least one HCE value among the plurality of HCE values using the PV data, the YP data, and the flow rate data.

9. The method of claim 1, further comprising:

transmitting, by a control system, a plurality of commands to the drilling system based on a well path through a subterranean formation; and adjusting, in response to the adjusted ROP value, the well path to produce an adjusted well path.

10. A system, comprising:

a drilling system comprising a drill string and a plurality of sensors, wherein the drilling system is coupled to a wellbore;

a mud pump system coupled to the wellbore, wherein the mud pump system is configured to supply drilling fluid to the wellbore;

a user device; and a control system coupled to the drilling system, the user device, and the mud pump system, wherein the control system comprises a computer processor, the control system being configured to perform a method comprising:

obtaining, in real-time, well data regarding the wellbore and drilling fluid data regarding the drilling fluid;

determining, based on the drilling fluid data, a plastic viscosity (PV) value and a yield point (YP) value regarding the drilling fluid;

determining, based on the well data and the drilling fluid data, an equivalent circulating density (ECD) value of an annulus of the wellbore;

determining a plurality of hole cleaning efficiency (HCE) values for a plurality of depth intervals in the wellbore based on a hole cleaning model, the PV value, the YP value, the ECD value, and a plurality of rate of penetration (ROP) values for a drilling operation in the wellbore, wherein the plurality of HCE values describe different hole cleaning states based on different rheological parameters of the drilling fluid in the wellbore;

presenting, using a graphical user interface on the user device, the plurality of HCE values for the plurality of depth intervals in the wellbore;

determining a plurality of adjusted ROP values for the drilling operation in the wellbore based on the plurality of HCE values and a current ROP value;

obtaining, using the graphical user interface and in response to presenting the plurality of HCE values for the plurality of depth intervals, a user selection of an adjusted ROP value among the plurality of adjusted ROP values associated with the plurality of HCE values; and transmitting, in response to obtaining the user selection of the adjusted ROP value, a command to the drilling system that produces the adjusted ROP value in the drilling operation.

11. The system of claim 10, wherein the control system further comprises functionality for:

determining a cuttings concentration in the annulus (CCA) value based on an ROP value, a hole size value, a flow rate value of the drilling fluid, and a transport ratio value; and determining an effective mud weight of the drilling fluid based on a static mud weight and the CCA value, wherein the ECD value is based on the effective mud weight, the PV value, and the YP value.

12. The system of claim 10, wherein the control system further comprises functionality for:

determining an annulus velocity (AV) value based on a cuttings velocity and a slip velocity, wherein the AV value corresponds to a minimum velocity required to lift cuttings during a drilling operation, wherein at least one HCE value among the plurality of HCE values is based on the AV value, the PV value, the YP value, and a mud weight value, and wherein the slip velocity is based on a hole inclination correction factor, a particle size correction factor, a mud weight correction factor, and a drilling fluid apparent viscosity.

13. The system of claim 10, further comprising:

a plurality of mud property sensors coupled to the control system, wherein the PV value and the YP value are determined using sensor data from the plurality of mud property sensors, and wherein the control system determines at least one HCE value among the plurality of HCE values using the PV data, the YP data, and flow rate data from the mud pump system.

14. The system of claim 10, wherein the control system further comprises functionality for:

transmitting a plurality of commands to the drilling system based on a well path through a subterranean formation; and adjusting, in response to the adjusted ROP value, the well path to produce an adjusted well path.

15. The system of claim 10, wherein the drilling fluid data comprises a plurality of rheological values, one or more funnel viscosity values, and an average cutting size value, and wherein the well data corresponds to a plurality of well parameters comprising one or more hole inclination values, one or more pipe diameters, and one or more hole diameters.

16. A user device, comprising:

a display device;

a processor coupled to the display device; and a memory coupled to the processor, the memory comprising instructions with functionality for:

presenting, using a graphical user interface in the display device, a plurality of hole cleaning efficiency (HCE) values for a plurality of depth intervals in a wellbore, wherein the plurality of HCE values are based on a hole cleaning model, a plastic viscosity (PV) value, a yield point (YP) value, an equivalent circulating density of an annulus (ECD) value regarding the wellbore, and a plurality of rate of penetration (ROP) values for a drilling operation in the wellbore, wherein the plurality of HCE values describe different hole cleaning states based on different rheological parameters of a drilling fluid circulating in the wellbore;

determining a plurality of adjusted ROP values for the drilling operation in the wellbore based on the plurality of HCE values and a current ROP value;

obtaining, using the graphical user interface and in response to presenting the plurality of HCE values for the plurality of depth intervals, a user selection of an adjusted ROP value among the plurality of adjusted ROP values associated with the plurality of HCE values; and transmitting, in response to obtaining the user selection, a command to a drilling system that produces the adjusted ROP value in the drilling operation.

17. The user device of claim 16, wherein the graphical user interface provides communication to a control system coupled to the wellbore, and wherein the graphical user interface obtains drilling operation data, drilling fluid data, and well data regarding the wellbore from the control system.

18. The user device of claim 16, wherein the ECD value is based on an effective mud weight, the PV value, and the YP value, wherein the effective mud weight of the drilling fluid is determined based on a static mud weight and a cuttings concentration in the annulus (CCA) value, and wherein the CCA value is based on an ROP value, a hole size value, a flow rate value of the drilling fluid, and a transport ratio value.

19. The user device of claim 16, wherein the memory further comprises functionality for:

transmitting a plurality of commands to the drilling system based on a well path through a subterranean formation; and adjusting, in response to the adjusted ROP value, the well path to produce an adjusted well path.

* * * * *